US005830055A

United States Patent [19]

Jones et al.

[11] Patent Number: 5,830,055

[45] Date of Patent: Nov. 3, 1998

[54] COIN/TOKEN CANISTER AND EJECTION MECHANISM

[75] Inventors: Michael F. Jones, Mt. Vernon, N.H.; Paul O. Stump, Topsfield, Mass.

[73] Assignee: Telequip Corporation, Hollis, N.H.

[21] Appl. No.: 744,696

[22] Filed: Nov. 7, 1996

[51] Int. Cl.[6] ..... G07D 1/00

[52] U.S. Cl. ..... 453/41; 221/197; 453/61

[58] Field of Search ..... 453/20, 21, 40, 453/41, 60, 61, 62; 221/197, 198

[56] References Cited

U.S. PATENT DOCUMENTS

| | | | |
|---|---|---|---|
| 1,401,957 | 1/1922 | Boulton | 453/62 |
| 3,125,104 | 3/1964 | Tryon | 453/21 |
| 3,486,658 | 12/1969 | Cheslak et al. | 221/197 |
| 3,935,873 | 2/1976 | Johnson | 453/41 |
| 4,606,362 | 8/1986 | Kobayashi et al. | 453/41 |

FOREIGN PATENT DOCUMENTS

| | | | |
|---|---|---|---|
| 2027967 | 2/1980 | United Kingdom | 453/61 |

OTHER PUBLICATIONS

Telequip Corporation, Product Depiction.

Telequip Corporation, Transact Coin Dispenser with Cointrak, Product Literature.

Brandt, Inc., Model # 559, Accuchange Coin Dispenser, Product Literature, 1988.

Brandt, Inc., Model # 580, Cashier Coin Dispenser, Product Literature.

Brandt, Inc., Model # 583, Remote Keyboard Dispenser, Product Depiction.

*Primary Examiner*—F. J. Bartuska

*Attorney, Agent, or Firm*—Perman & Green, LLP

[57] ABSTRACT

A portable canister for holding coin-like objects for ejection from a dispenser has a lid and a substantially box-like base that are either attached pivotally at one or more hinges so that the canister may be opened in a clamshell fashion a full 180 degrees or that come together in a box-like fashion without the use of hinges, the cover being lifted entirely off the base for loading. Inside the canister base is a side-by-side array of columns, each column having sides encircling the column circumference by no more than 180 degrees in order to allow horizontal loading of stacks of coins. The lid operates to trap the coins into the columns of the base. The closed canister has slots in the plane of the lid to permit ejection of coins one at a time from each column. An ejection mechanism mounted in the dispenser chassis employs one solenoid subassembly per column of a removable canister. Each solenoid plunger protrudes into the canister base at all times when the canister is mounted and rests underneath a land in the base of the canister. The bottom coin in the stack in each column rests below the bottom of the land on a pad located entirely within the canister base, allowing the plunger to be accurately positioned with respect to the coin. When the ejection mechanism is activated, the plunger strikes only the bottom coin in the stack, pushing it off the pad into the coin chute.

15 Claims, 4 Drawing Sheets

COIN/TOKEN CANISTER AND EJECTION MECHANISM

FIELD OF THE INVENTION

The present invention relates to electro mechanical devices and, in particular, to coin or token dispensing mechanisms.

BACKGROUND

Coin and token dispensing machines typically consist of a body portion, or chassis, to which a separate coin/token canister or magazine is removably attached. The chassis has a ramp or chute down which the coins or tokens roll after ejection from the canister. To keep the canister from being removed by an unauthorized individual, a lock is often provided on the dispenser body that locks the canister in place within the body portion of the machine.

Coin/token canisters have typically been constructed of metal, generally aluminum extrusion. This means that a fully loaded canister is fairly heavy, making it difficult to carry more than one at a time. In addition, canisters have not been smooth on their outside surfaces, often having various protrusions, such as handles, that prevent multiple canisters from being easily stacked for storage or carrying. As coin canisters must be moved frequently for refilling, etc., this can be a significant consideration in the use of coin dispensing machines.

A coin/token canister or magazine consists in its simplest form of a series of columns or chambers sized to fit the intended coins or tokens. The columns can all be identical in width, such as is typically found in token dispensers, or can be sized differently, such as is found in a machine capable of dispensing several different-sized coins.

The sides of the columns of all prior art coin/token canisters are specifically designed to wrap more than half way around the column circumference in order to maintain the coins or tokens in place. This forces the coins or tokens to be loaded from the top of each column, often resulting in coins flipping up and jamming unless they are aimed perfectly into the top of the column. Because of this, an entire roll of coins or tokens usually must be inserted into the column in several parts.

The typical prior art coin/token canister is constructed in a substantially box-like configuration that is opened either via a hinge mechanism or by sliding off an outer sleeve. The prior art hinged canister typically has a base portion that contains vertical columns arranged in a side-by-side manner. The coins or tokens are loaded vertically into the column array and then the coins are secured in the loaded columns by closing the lid down onto the side of the array of columns. For the typical prior art canister that employs an outer sleeve, the columns are also loaded while the column array remains vertical and then the hollow sleeve is slipped down over the top of the column array to secure the coins in the loaded columns. Both types of prior art canister require the columns to be vertical for proper loading.

Prior art coin ejection mechanisms typically employ an array of solenoids, one per column. When a solenoid in the array is electrically energized, the coin is driven out of the particular coin dispenser column by striking the solenoid plunger against the coin that is the lowest in the column, the coin having previously dropped down below the edge of the canister in preparation for ejection. Using this mechanism, there are often mistakes in lining the solenoid plunger up with the coin or token, causing the coin or token to sometimes get stuck, be missed entirely, or even sometimes causing more than one coin to be ejected from a single canister column at a time. In particular, these problems tend to be caused by fabrication and manufacturing tolerances or to occur as the machine parts wear over time, causing the coin or solenoid plunger, or both, to be positioned increasingly incorrectly, particularly with respect to each other.

OBJECTS OF THE INVENTION

Accordingly, a primary object of the present invention is to provide a coin/token canister and ejection mechanism that are easier and more efficient to use, carry, and store.

In particular, an object of the present invention is to provide a canister that can be more easily and efficiently loaded than prior art coin canisters.

A further particular object of this invention is to provide a coin/token canister that weighs less, stacks more efficiently, and can be carried more easily than prior art coin canisters.

An additional particular object of this invention is to provide an ejection mechanism that ejects coins and tokens more easily and more accurately than prior art coin ejection mechanisms.

SUMMARY

In one aspect of the invention, a canister for holding flat, disk-like objects such as coins or tokens that are to be dispensed from a coin or token dispenser has a base and lid that are pivotally attached at one or more hinges so that the canister is opened in a clam-shell fashion. In a preferred embodiment, the canister is fabricated from reinforced molded plastic materials and the surfaces of the canister are smooth in order that multiple coin canisters may be stored flat and stacked together. The canister may optionally incorporate a carrying handle.

In another aspect of the invention, the hinges on the canister operate as a pivot point and allow the canister to be opened 180 degrees to a flat position. When the canister is closed, the base and cover can either meet smoothly without overlap or the inner and outer edges of the base and cover may be constructed so that the inner edge of one is overlapped by the outer edge of the other. Once the canister is closed, it may be retained in a closed position by one or more optional catches that are released through the operation of one or more buttons.

In another aspect of the invention, the canister cover and base may fit together in a box-like fashion, without the need for hinges, with the cover being lifted entirely off the base for the loading of coins. In this aspect of the invention, the base and cover may be held together when closed by at least two opposing catches with one or more buttons to disengage the catches.

Inside the canister base is a side-by-side array of columns for holding the coins or tokens. The sides of the columns wrap no more than halfway around the column circumference, allowing direct horizontal loading of stacks of coins into the columns. The canister has slots at the base of the lid that permit ejection of the coins one at a time from each column.

In another aspect of the invention, the coin canister is designed to be preferentially placed vertically into the coin dispenser chassis. In the preferred embodiment, the canister is locked into the chassis, preventing accidental or unauthorized removals. In one aspect of the invention, the lock resides on the coin dispenser chassis and the canister has a slot through which the lock on the chassis can engage and hold the canister in place. The canister may also have its own locking mechanism, allowing the canister to be locked while it is being transported. A removable sleeve or shoe may also be attached to the coin canister to prevent coins from dropping out of the canister during transport, also with an optional locking mechanism. The canister may have windows for viewing the coin level in each column and may optionally be configured to allow detection of when the coin level in a column drops below a predetermined level.

In a further aspect of the invention, the coin ejection mechanism employs a solenoid subassembly for each column in the coin canister, mounted in the coin dispenser chassis, except for the solenoid plunger which protrudes into the canister base. When the canister is in place in the chassis, each solenoid plunger rests against a land which is molded directly into the base of the coin canister. The bottom coin in the stack in the column rests just below the bottom of the land on a pad. The land, in combination with the protrusion of the solenoid plunger into the canister itself, allows more reliable coin ejection than in prior art devices because the solenoid plunger can be accurately positioned with respect to the coin and will not accidentally strike the coin above the bottom coin during coin ejection.

When the coin ejection mechanism is activated, the solenoid plunger strikes the bottom coin in the stack, pushing it off the pad into the coin chute and subsequently into the coin cup. After striking the bottom coin, the solenoid plunger returns to its starting position just beneath the land and the next higher coin in the stack drops down onto the now-vacant pad. The solenoids are driven by a signal from a main microprocessor resident in the coin dispenser chassis.

DETAILED DESCRIPTION OF THE PREFERRED EMBODIMENT

Figure 1A:
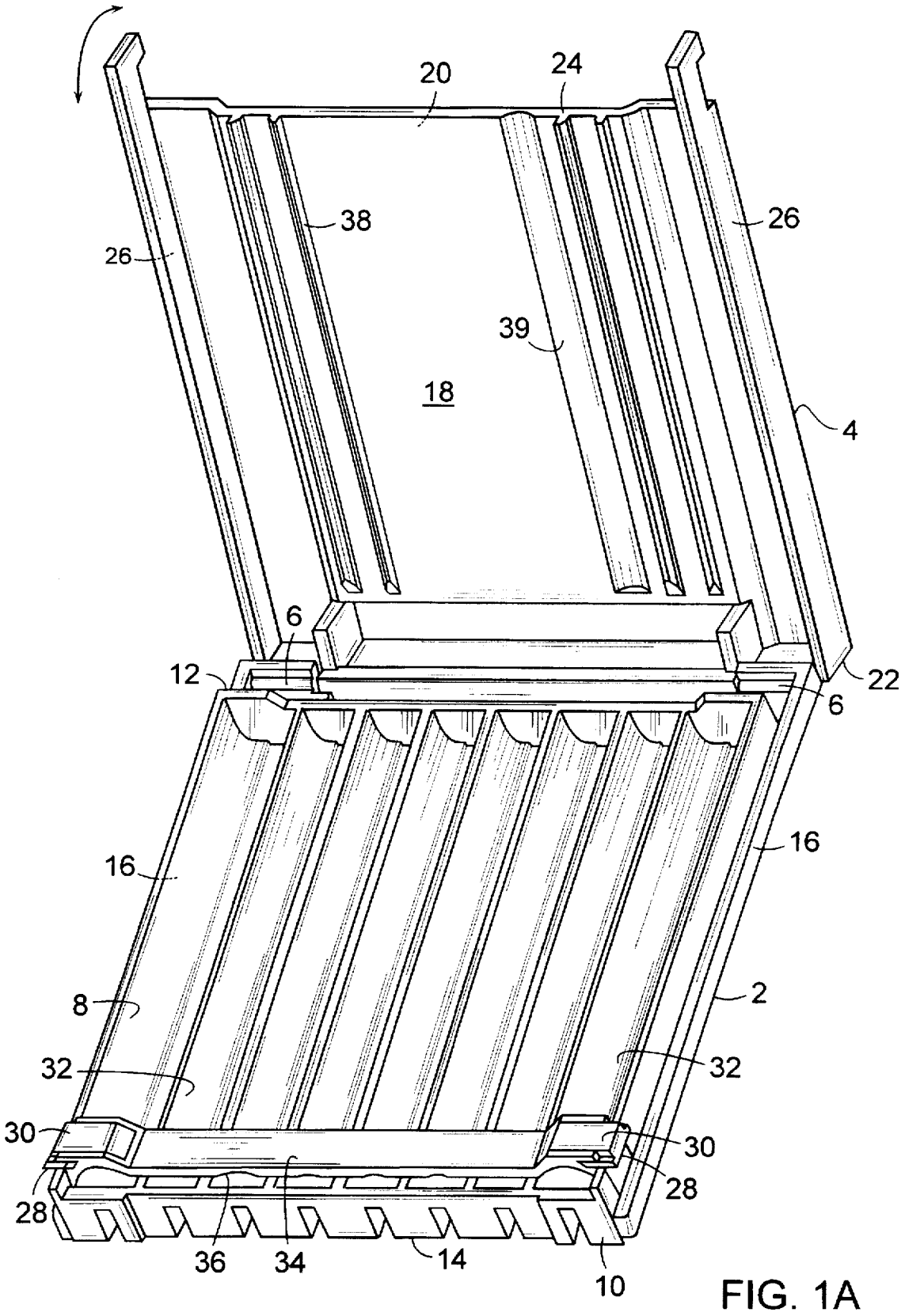
FIG. 1A is an embodiment of the coin canister of the present invention in an open position.

As shown in FIG. 1A, a canister, or magazine, for holding coins or tokens for dispensing from a coin or token dispenser has a base 2 and a lid or cover 4 that are pivotally attached at two hinges 6. While in the embodiment shown the hinges 6 are constructed so as to be integral to the canister base 2 and cover 4, this is not necessary for the operation of the invention and any form of pivotable hinge known in the art would be suitable. In the preferred embodiment, the hinges 6 are stainless steel for durability. Similarly, while FIG. 1A illustrates the use of two hinges, a canister having one or no hinges, as well as one having more than two hinges, is contemplated by the inventors and is thus within the scope of the invention.

The base 2 and cover 4 of the canister are each substantially box-like in shape. The base 2 has an inside 8 and an outside 10, with the base outside 10 having a top edge 12, a bottom edge 14, and two side edges 16. Similarly, the cover 4 has an inside 18 and an outside 20, as well as a top edge 22, a bottom edge 24, and two side edges 26.

In a preferred embodiment, the coin/token canister is fabricated from reinforced molded plastic materials, such as abrasion resistant molded foam. Construction from reinforced plastic materials makes the coin canister lighter than prior art coin canisters. The surfaces of the coin canister base outside 10 and cover outside 20 in the preferred embodiment are smooth in order that multiple coin canisters may be stored flat and stacked together.

As shown in FIG. 1A, in one embodiment the canister has two hinges 6 at the top surfaces 12 and 22 of the canister base 2 and cover 4 respectively. The hinges 6 operate as a pivot point and allow the canister to be opened in a clam shell fashion, so that the base 2 and cover 4 are 180 degrees apart when the canister is in a flat, fully open position. In the preferred embodiment, the canister opens from the bottom edges 14 and 24 of the base 2 and cover 4, but it could also open from the top edges 12 and 22 or either of the side edges 16 and 26, with the hinges 6 then being located on the correspondingly opposite side from the side of opening.

When the canister is closed, the base 2 and cover 4 can either meet smoothly without overlap at their inner and outer edges or the inner and outer edges of the base 2 and cover 4 may be constructed so that the inner edge of the base 2 is overlapped by the outer edge of the cover 4. The reverse arrangement, where the inner edge of the cover 4 is overlapped by the outer edge of the base 2, is also satisfactory for the operation of the invention. The overlap can be a true overlap, where the edge of the cover overlaps or is overlapped by the entire edge of the base, or it can be partial, with the edges of both the cover and base being notched or stepped lengthwise to accommodate the overlap. In the preferred embodiment of the invention, the transition at the place of joining of the base 2 and lid 4 will be smooth, regardless of whether or not there is overlap of the base 2 and cover 4.

As seen in the embodiment of FIG. 1A, once the canister is closed it is retained in a closed position by two catches 28 that engage when the lid or cover 4 is snapped shut onto the base 2. The catches can be any of the number of such catches that are well known in the art for holding device lids or doors closed. While two catches are shown, obviously one catch or more than two catches would also be suitable. While the preferred embodiment of the invention includes at least one catch, it is recognized by the inventors that it may be desirable in certain applications not to include a catch at all, and the catches 28 are accordingly not required for proper operation of the invention.

Once the catches 28 have been engaged by snapping the cover 4 onto the base 2, they can be released through operation of the buttons 30. The buttons 30 can be designed to operate in either a push-button or a sliding manner and can be of any type known in the art to be suitable for such purposes. Each button 30 can operate to release a single catch or can be designed to operate two or more catches.

In an alternate embodiment, the canister cover 4 and base 2 fit together in a box-like fashion, without the need for the hinges 6 of FIG. 1A. In this embodiment, the cover 4 is lifted entirely off the base 2 for the loading of coins. The base 2 and cover 4 are held together when closed by at least two catches of the type of the catches 28, placed either at both the top 12 and 22 and the bottom edges 14 and 24 of the base 2 and cover 4 or on both side edges 16 and 26. As with the hinged embodiment, the catches can be installed either with or without individual buttons 30 to separately disengage each catch.

Inside the canister base 2 are a side-by-side array of one to several chambers or columns 32 for holding the coins or tokens. In FIG. 1A, the preferred embodiment having eight columns is shown. The sides of the columns 32 wrap no more than halfway (180 degrees) around the column circumference. This allows direct loading of stacks of coins into the columns 32 from the side while the columns are horizontal and the canister lays flat, as opposed to loading the coins from the top of vertical columns as is the case with prior art canisters.

While the embodiment of FIG. 1A is designed to hold coins, both the coin canister and coin ejection mechanism of the invention can be use to dispense any flat disk-like object, such as tokens or gambling chips. All of the columns 32 may be identical in diameter, or each column may be sized differently in order, for example, to accommodate the different diameters and thicknesses of coins. The columns 32 may optionally have calibration strips on the inside of each column in order to allow visual calculation of the number of coins stacked in each column 32 at a given time.

Coins or tokens that have been loaded into the bottom of a column 32 are trapped there in the preferred embodiment by an extrusion 34 that extends across the width of the canister base 2 on the inside 8. In the preferred embodiment, the extrusion is made of metal, such as aluminum, in order to better resist the wear caused by the repeated action of the coin ejection mechanism in exerting a sideways force on the stack of coins each time a coin is ejected from the column 32. As shown in the embodiment of FIG. 1A, the extrusion 34 may contain one or more notches or molded areas 36 to conform the extrusion 34 to the width and curvature of the coins intended for each column. In an alternate embodiment, the canister cover 4 may instead perform the function of the extrusion 34 by extending far enough over the base 4 to cover the bottom of the columns 32.

Figure 1B:
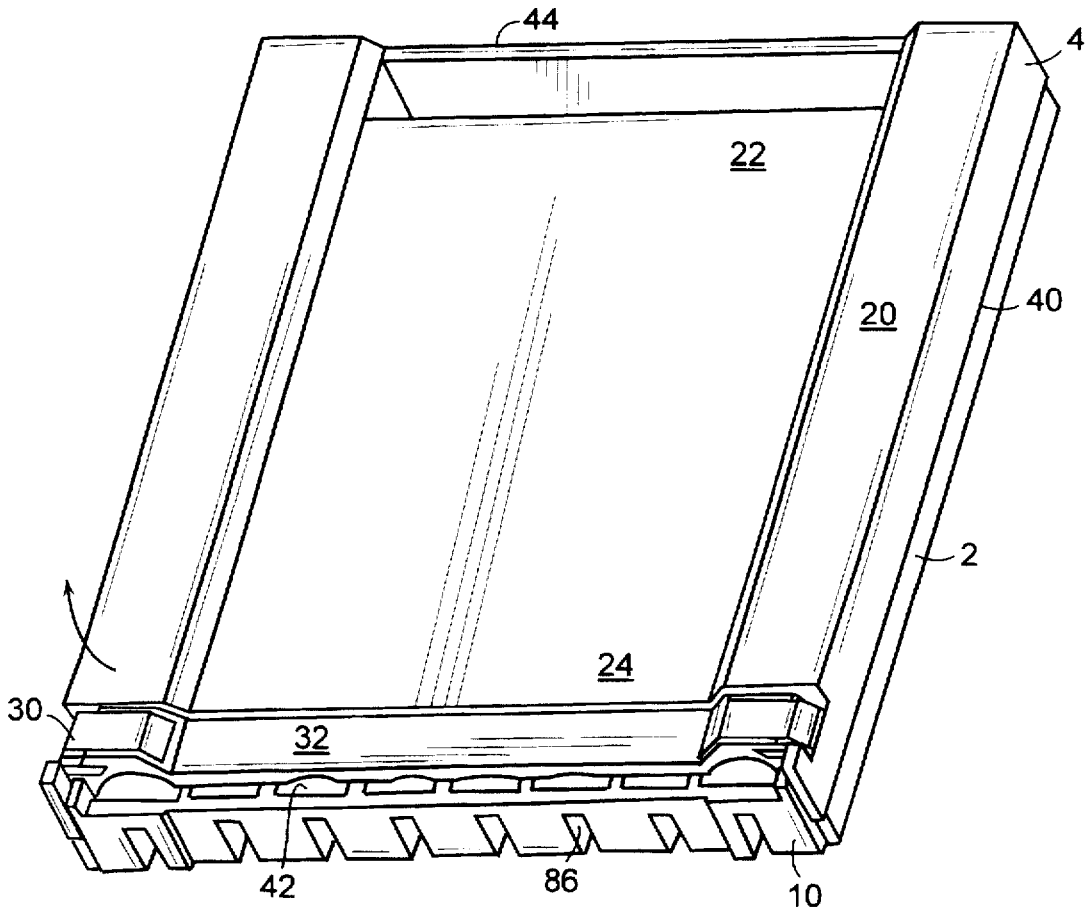
FIG. 1B is the embodiment of FIG. 1A in the closed position.

Stacks of coins or tokens are loaded horizontally into the base of the canister. As shown in FIG. 1B, closing the cover 4 so that the edges of the lid 4 and base 2 meet in a clam-shell fashion captivates the coins and keeps them in place. In the preferred embodiment, the edges of the cover 4 and base 2 meet at a smooth join 40, to facilitate insertion of the canister into the coin dispenser chassis. As shown in FIG. 1A, the inside 18 of the cover 4 may have molded 38 or recessed 39 areas to accommodate different sizes of coins and facilitate their capture in the columns 32 when the cover 4 is closed.

The canister has holes or slots 42 below the extrusion 34 in order to permit ejection of the coins one at a time from each column. In the preferred embodiment, individual slots 42 are present on the lower front of the canister. There is a separate slot 42 for each column, and each slot 42 is sized to the width and thickness of the coins or tokens that will be stacked in the corresponding column.

Alternatively, there may be a single slot, either below the extrusion 34 or extending across the lower edge of an extended canister cover, that is utilized for ejection from all columns instead of having an individual slot for each column. This implementation has a drawback, however, potentially allowing coins to slide over into space utilized by the other columns rather than being ejected and therefore possibly causing the jamming of coins in the affected column. Another alternate embodiment has holes in the canister base at the bottom of each column. In this embodiment the coins are ejected from the dispenser from outside the canister but within the dispenser chassis in an area below where the canister sits in the chassis.

As shown in FIG. 1B, the canister may be optionally constructed to incorporate a carrying handle 44. In the preferred embodiment, the carrying handle 44 is integral to the canister. An integral configuration helps keep the carrying handle 44 from being damaged or in the way when multiple canisters are stacked. Any number of other methods well-known in the art for the construction and attachment of carrying handles would be equally suitable.

In the preferred embodiment, the canister is locked into the coin dispenser chassis, preventing both accidental removal and intentional removal by unauthorized individuals. Any type of locking mechanism designed for locking two objects together is suitable, but in the preferred embodiment the lock itself resides on the coin dispenser chassis. When the locking mechanism resides on the coin dispenser chassis, the canister needs only to have a slot through which the lock on the chassis can engage and hold the canister in place.

Optionally, the canister may also have its own locking mechanism, allowing the canister to be locked while it is being transported. The canister locking mechanism can be any locking mechanism known in the art and can be positioned anywhere on the canister where it does not interfere with the canister's operation, opening, or insertion into the chassis of the coin dispenser.

A removable sleeve or shoe can be attached to the coin canister to prevent coins from dropping out of the canister during transport, particularly when the canister is not fully loaded and the coins in the bottom of the column are not trapped by the weight of the rest of the coins in the column. The shoe can optionally have a locking mechanism to prevent unauthorized access to the coins during transport. The shoe locking mechanism can take any number of forms well-known in the art, but in the preferred embodiment will be resident on the shoe itself and will lock into the coin canister using the same slot via which the locking mechanism on the coin dispenser chassis engages the canister.

Figure 2:
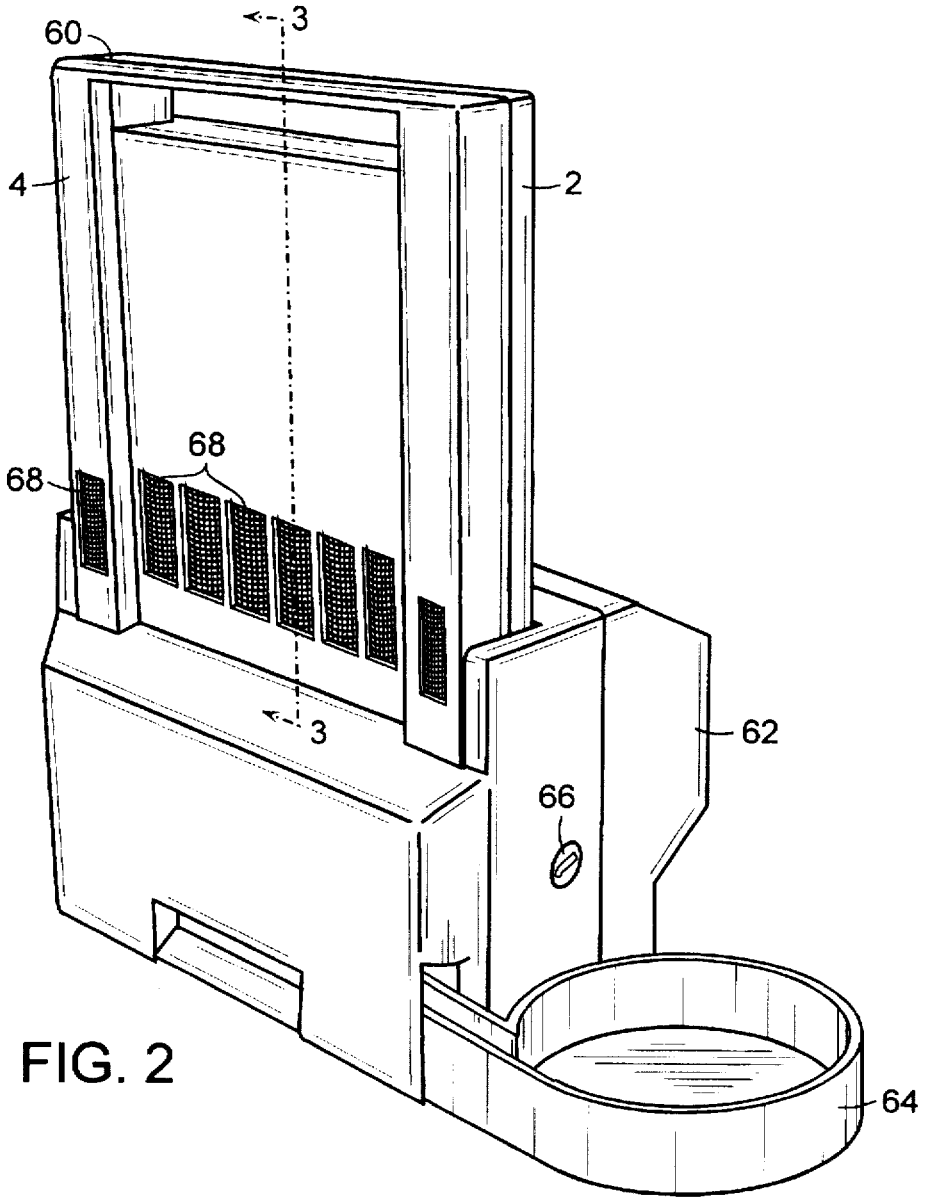
FIG. 2 is an embodiment of the coin canister of the present invention installed in a coin dispensing machine.

As shown in FIG. 2, the coin canister 60 is designed to be preferentially placed vertically into the coin dispensing machine chassis 62. In the preferred embodiment shown in FIG. 2, the canister 60 is oriented in the chassis 62 so that the lid 4 of the canister 60 faces the viewer, but the invention does not require this orientation and any relationship between the chassis 62 and canister 60 that allows the coins to be ejected into the coin chute is suitable. The canister 60 is positioned in the chassis 62 so that it does not interfere with the function of or access to the coin cup 64.

In the preferred embodiment, the canister 60 is locked into the chassis 62 by a locking mechanism 66. When the canister 60 is in place in the dispenser chassis 62, access to the buttons that open the canister is prevented. The locking mechanism 66 may be of any type known in the art for locking two such objects together and can be located at any place on the chassis 62 that is convenient and does not interfere with the operation of the coin dispenser. Alternatively, the locking mechanism 66 could be located directly on the canister 60 in any position that does not interfere with the operation of either the canister or the dispenser or with the insertion of the canister 60 into the dispenser chassis 62.

In FIG. 2, the canister 60 has optional windows 68 for viewing the coin level in each column. The viewing windows 68 in the embodiment of FIG. 2 are on the canister lid 4, but they can alternatively be positioned on the canister base 2. Optimally, the windows 68 are located towards the bottom edge of the canister 60 in order that the windows 68 may be used to ascertain when the coin levels have begun to get low.

Figure 3:
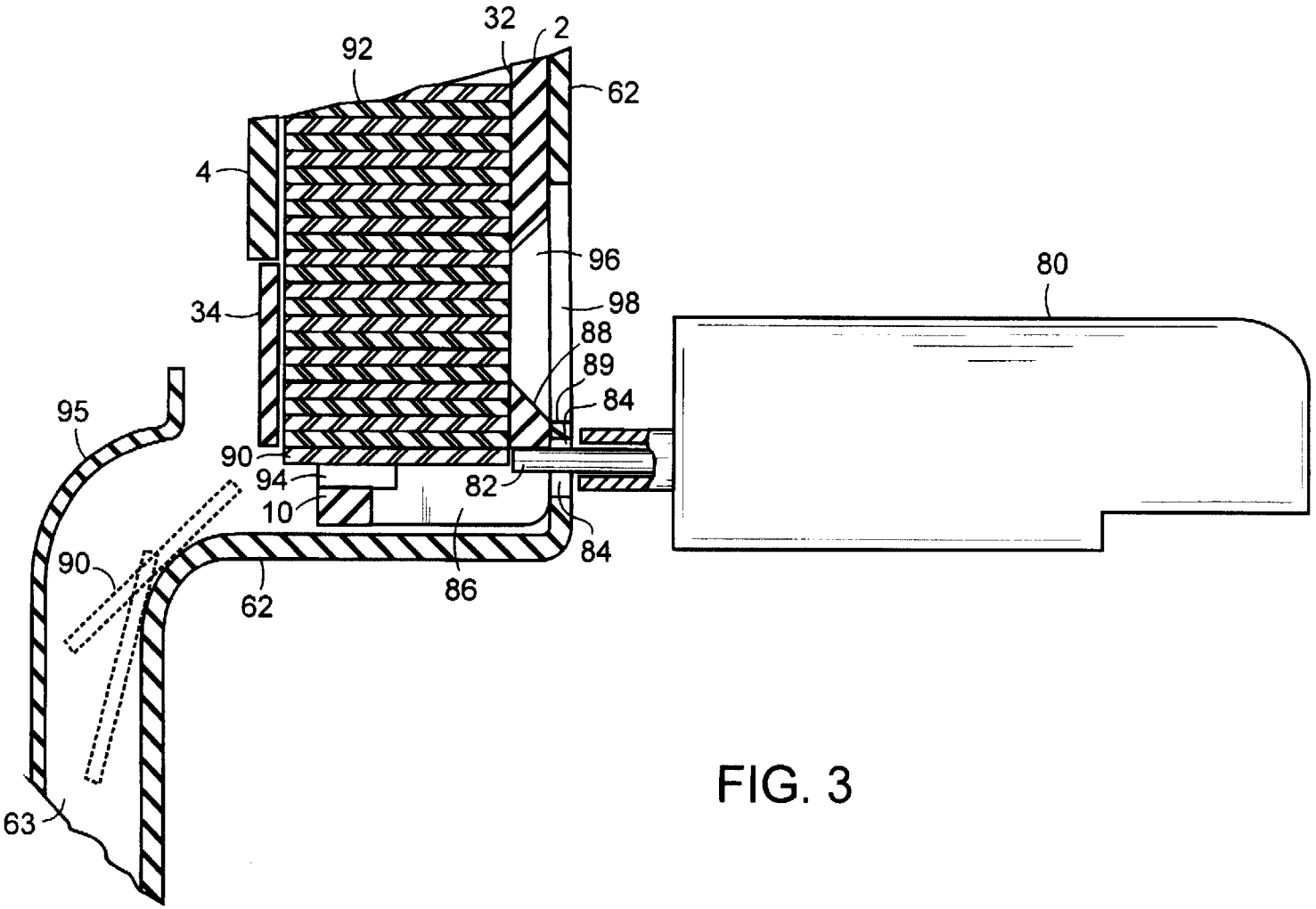
FIG. 3 is an embodiment of the coin ejection mechanism of the present invention operably connected to an embodiment of the coin canister of the present invention.

As shown in FIG. 3, a coin ejection mechanism employs a separate linear solenoid subassembly 80 for each column 32 in a coin canister. The solenoid subassembly 80 consists of a linear solenoid with a solenoid plunger 82 in a mounting bracket that is located entirely in the coin dispenser chassis 62 except for the solenoid plunger 82, which protrudes into slot 86 in the canister base 2 through a hole 84 in the chassis 62. The slots 86 are also visible in FIG. 2 on the bottom side 10 of the base 2. It is necessary that the slots 86 extend through the bottom 10 of the base 2 because this allows the canister 60 to be inserted into the dispenser chassis 62 without interfering with the solenoid plungers 82.

When the canister 60 is in place in the chassis 62, each solenoid plunger 82 rests against a land 88 which is molded directly into the base 2 of the coin canister 60. The chassis 62 is constructed so that the area 89 forming the top edge of the space 84 does not contact the plunger 82 when the canister is in place. The plunger 82 instead rests solely against the canister land 88, which acts to stabilize the plunger 82 before and during the coin strike. The canister base 2 is constructed so that the bottom coin 90 in the stack of coins in the column 32 rests just below the bottom of the land 88 on a pad 94.

The bearing of the solenoid plunger 82 directly against the land 88 in the canister itself, without contacting the edge 89 of the canister chassis 62, allows more reliable coin ejection than in prior art devices because the solenoid plunger 82 and coin stack 92 are now both being positioned with respect to the canister. This means that the plunger 82 can be accurately aligned with the coin stack 92 and therefore will not accidentally strike the coin above the bottom coin 90 during coin ejection. Prior art coin ejection mechanisms either do not protrude the coin striking device into the coin canister in this manner, typically having the plunger or other device instead strike the coin either below or at the edge of the canister, or do not rest the plunger or other striking device solely against an area in the canister itself, instead positioning the device from within the coin dispenser chassis.

Use of the land 88 in combination with the protrusion of the solenoid plunger 82 into the canister base 4 allows the coin ejection mechanism of the present invention to be free of the tolerance buildup experienced by prior art ejection mechanisms. The land 88 prevents the solenoid plunger 82 from being misaligned and consequently striking higher in the coin stack 92 than the bottom coin 90. Because the bottom coin 90 remains completely in the canister until it is ejected, and because it rests on the pad 94 which experiences little of the force of the strike of the plunger 82, the position of the bottom coin 90 remains consistent, even with accumulated wear over time. This minimizes the chance that the next higher coin in the stack 92 will be positioned low enough that it can be accidentally struck by the solenoid plunger 82 during ejection of the bottom coin 90.

When the coin ejection mechanism is activated, the solenoid plunger 82 strikes the bottom coin 90 in the stack 92, pushing it off the pad 94 and into the coin chute 63. From there the coin 90 is deflected by the deflector 95 and rolls or falls into the coin cup 64. The extrusion 34 keeps the coins remaining in the stack 92 from being driven out of the column 32 by the frictional force exerted by the bottom coin 90 leaving the canister. After striking the bottom coin 90, the solenoid plunger 82 returns to its starting position just beneath the land 88 and the next higher coin in the stack drops down onto the now-vacant pad 94.

The linear solenoids are electrically driven by a signal from a main microprocessor resident in the coin dispenser chassis. The microprocessor examines the input signal from the cash register, teller's machine, etc. to which the coin dispenser is coupled and determines from which columns coins should be ejected. The microprocessor then sends a signal to each solenoid associated with a column from which coins are to be ejected and the solenoid activates the solenoid plunger 82 to eject the coin 90 from the canister 60 into the coin chute 63.

In order to facilitate electronic detection of coin levels in each column during operation of the coin dispenser, the canister may optionally be configured to allow a flag to be set when the coin level in a column drops below a predetermined level. As shown in the preferred embodiment of FIG. 3, for each column 32 the canister base 2 has a hole very close to the bottom 10 of the base 2. Through the hole 96, the level of coins in the stack 92 in the column 32 can be monitored using either or both electronic or mechanical means.

In one embodiment, a mechanical flag for each column 32 is positioned in the dispenser chassis 62 at a hole 98 that corresponds to the hole 96 in the lower canister base 2. When the column 32 is full, the flag is physically kept out of the way of an optical detector by the stack 92 of coins. When the stack 92 drops below the hole 96, the flag automatically drops into the hole. The optical detector sees the flag and sends a signal to the main microprocessor to tell it that the column 32 is nearly empty. This is useful for keeping the controlling cash register, teller's station, etc. informed as to the state of the cash dispenser, as well as for more evenly depleting the contents of the individual columns.

Modifications and substitutions by one of ordinary skill in the art are considered to be within the scope of the present invention, which is not to be limited except by the claims which follow.

What is claimed is:

1. A portable canister for holding a plurality of flat, disk-like objects for dispensing from a machine, comprising, in combination:

base means, said base means being substantially box-like and having an interior and an exterior;

lid means for trapping said disk-like objects, said lid means having an interior side and an exterior side, said lid means being conformed in a manner designed to efficiently trap said disk-like objects securely into said base means when said lid means is pressed into a closed position on top of said base means;

slot means for ejection of said flat, disk-like objects from said canister, said slot means being entirely in the plane of said lid means and being formed by a gap between the end of said lid means and the edge of said base means when said lid means is in said closed position;

column means for securely and entirely holding said disk-like objects, said column means being substantially within said interior of said base means, said column means comprising at least one column having a circumference and sides that encircle said circumference by no more than 180 degrees; and pad means for supporting a next one of said disk-like objects within said storage canister in preparation for dispensing, said pad means being located wholly within said interior of said base means, in a position at the bottom of said column means and adjacent to said slot means.

2. The canister of claim 1, wherein said column means comprises an array of columns, each of said columns being sized to accommodate a specific size of said flat, disk-like objects.

3. The canister of claim 2, further comprising at least one hinge means operative to connect said lid means to said base means in a clamshell fashion.

4. The canister of claim 2, wherein said lid means attaches to said base means in a box-like fashion, said lid means and said base means further including at least one catch means for holding said lid means onto said base means and at least one release means for disengaging said lid means from said base means after said catch means has been engaged.

5. The canister of claim 3, further including at least one catch means for holding said lid means against said base means and at least one release means for disengaging said lid means from said base means after said catch means has been engaged.

6. The canister of claim 1, further including a locking means for preventing unauthorized access to said flat, disk-like objects in transport or during dispensing.

7. The canister of claim 1, further including a detachable shoe covering said slot means to prevent said flat disk-like objects from falling or being taken out of the canister during transport.

8. The canister of claim 1, further including a carrying handle.

9. The canister of claim 2, further comprising means for visual or electronic monitoring of levels of said flat disk-like objects in said columns.

10. An ejection mechanism for ejecting coin-like objects from a removable storage container, said storage container having a lid and a base, said mechanism comprising, in combination:

a solenoid means, said solenoid means activated by an electronic signal;

a solenoid plunger, said solenoid plunger being operatively attached to said solenoid means, said solenoid plunger further being positioned so as to protrude into said removable storage container when said removable storage container is in place and said solenoid means is in both resting and activated states, said solenoid plunger being moved by said solenoid means in response to said electronic signal so as to strike a single one of said coin-like objects at a time and eject said single coin-like object from said removable storage container;

a land means, said land means being positioned within said base of said removable storage container so as to guide said solenoid plunger means within said storage containers;

slot means for ejection of said coin-like objects from said storage container, said slot means being entirely in the plane of said storage container lid and being formed by a gap between the end of said lid and the edge of said base when said lid means is in a closed position; and pad means for supporting a next one of said coin-like objects within said storage container in preparation for ejection, said pad means being located wholly within said interior of said storage container base, at a point adjacent to said slot means.

11. A magazine with ejection mechanism for coin-like objects, comprising, in combination:

magazine means, said magazine means comprising, in combination:

bottom tray means, said bottom tray means being substantially box-like and having an inside and an outside;

cover means for trapping said coin-like objects, said cover means having an interior side and an exterior side, said cover means being conformed in a manner designed to efficiently trap said coin-like objects securely into said bottom tray means when said cover means is pressed into a closed position on top of said bottom tray means;

slot means for accommodating ejection of said coin-like objects from said magazine, said slot means being entirely in the plane of said cover means and being formed by a gap between the end of said cover means and the edge of said bottom tray means when said cover means is in said closed position;

column means on said inside of said bottom tray means, said column means comprising at least one column having a circumference and sides that encircle no more than half-way around said circumference; and pad means for supporting a next one of said coin-like objects within said magazine means in preparation for dispensing, said pad means being located wholly within said interior of said bottom tray means, at a point located at the bottom of said column means and adjacent to said slot means;

at least one ejection means, said ejection means being outside said magazine, said ejection means further being activated by an electronic signal;

at least one ejection plunger, each of said at least one ejection plungers being operatively attached to one of said ejection means, each of said ejection plungers being positioned so as to protrude into said magazine at all times when said magazine is positioned for operation, each of said ejection plungers being moved by said operatively attached ejection means in response to said electronic signal so as to strike a single one of said coin-like objects for ejection of said coin-like object from said magazine through said slot means; and a guide means, said guide means being inside said bottom tray of said magazine and being positioned to guide said ejection plunger means within said magazine.

12. The magazine with ejection mechanism of claim 11 wherein said column means is comprised of a side-by-side array of columns and each of said at least one ejection means with said operatively attached ejection plunger is individually associated with a particular one of said columns.

13. The magazine with ejection mechanism of claim 11 wherein said ejection means is a solenoid and said associated ejection plunger is a solenoid plunger.

14. A coin dispensing machine, comprising, in combination:

coin dispensing machine chassis;

coin case, said coin case comprising, in combination:

base, said base containing at least one coin chamber wherein the sides of each of said at least one coin chambers encircle no more than half-way around the surface of said coin chamber, said base being substantially box-like and having an inside and an outside;

cover for trapping said coins, said cover having an interior side and an exterior side, said cover being conformed in a manner designed to trap said coins securely into said coin chambers of said base when said cover is pressed into a closed position on top of said base;

slot means for accommodating ejection of said coins from each of said coin chambers, each of said slot means being entirely in the plane of said cover and being comprised of a gap formed between the end of said cover and the edge of said base when said cover is in said closed position;

land means, said land means being inside said base of said coin case and being positioned to guide an ejection plunger within said coin case; and pad means for supporting a next one of said coins within said coin case in preparation for ejection from one of said coin chambers, said pad means being located wholly within said interior of said base, at a position at the bottom of said coin chamber, adjacent to said slot means; and coin ejection mechanism, said coin ejection mechanism comprising at least one ejection plunger operatively connected to a plunger activation means, each of said plunger activation means resting inside said coin dispensing machine chassis, each of said at least one plungers resting inside said coin case by bearing under the outer edge of an opening into said coin case and against said land means.

15. A method for ejecting disk-shaped objects from a storage canister, said storage canister comprising a lid portion and a base portion, said base portion having one or more storage columns for holding said disk-shaped objects in a stacked configuration, said method comprising, in combination, the steps of:

trapping said disk-shaped objects in said stacked configuration within said one or more storage columns of said storage canister by placing said lid portion on top of said base portion, creating a slot located substantially in the plane of said storage canister lid portion, said slot being formed by a gap formed between said lid portion and the edge of said base portion;

supporting a lowest one of said disk-shaped objects wholly within said storage canister on a pad located inside the edge of said base portion, in preparation for ejection of said lowest disk-shaped object from said storage canister;

providing an ejection control device outside said storage canister;

attaching at least one ejection rod to said ejection control device;

resting each of said ejection rods at least partially inside said base portion of said storage canister at all times, each of said ejection rods being one-to-one associated with one of said storage columns, each of said ejection rods resting underneath a guide in said base portion of said storage canister;

activating said ejection control device to move said ejection rod further into said storage canister; and ejecting said lowest one of one of said disk-shaped objects from one of said storage columns of said storage canister through said slot by hitting said lowest disk-shaped object with said one-to-one associated ejection rod.

* * * * *